US006883180B1

(12) United States Patent
Willis

(10) Patent No.: US 6,883,180 B1
(45) Date of Patent: Apr. 26, 2005

(54) HEADPIECE ORNAMENT

(76) Inventor: Joyann Elaine Willis, P.O. Box 160974, Sacramento, CA (US) 95816

( * ) Notice: Subject to any disclaimer, the term of this patent is extended or adjusted under 35 U.S.C. 154(b) by 62 days.

(21) Appl. No.: 10/633,228

(22) Filed: Aug. 1, 2003

(51) Int. Cl.[7] ..... A42B 1/24

(52) U.S. Cl. ..... 2/209.13; 2/244; 2/271; 63/1.11

(58) Field of Search ..... 2/171, 209.13, 2/244, 271, 195.1, 175.7; 63/1.11

(56) References Cited

U.S. PATENT DOCUMENTS 995,781 A * 6/1911 Gallrein ..... 2/271
2,287,865 A * 6/1942 Carleton ..... 63/1.11
RE24,277 E * 2/1957 Davis ..... 2/195.5
4,406,296 A * 9/1983 Wexler et al. ..... 132/148
5,530,970 A * 7/1996 Knutson ..... 2/209.13
6,026,515 A * 2/2000 Nielson et al. ..... 2/244
2004/0163297 A1 * 8/2004 Lin ..... 40/640

* cited by examiner

*Primary Examiner*—Rodney M. Lindsey
(74) *Attorney, Agent, or Firm*—Risto A. Rinne, Jr.

(57) ABSTRACT

An accent device for use with a headpiece includes a headpiece with at least one opening in the headpiece through which one end of the accent is inserted. An opposite end of the accent device is brought into contact with the one end and attached thereto. The accent device includes a structure that is disposed on a plane and can include any circular, oval, or polygonal shape. Any other item, including jewelry can also be attached to the accent device. A method for permanently attaching an accent piece to a headpiece is also described.

19 Claims, 2 Drawing Sheets

HEADPIECE ORNAMENT

BACKGROUND OF THE INVENTION

1. Field of the Invention

The present invention, in general relates to an ornamentation and, more particularly, to accent items and devices that adorn hats.

Headpieces come in all manner and variety. There are hats of all types, caps, sun visors, berets, beanies, wool hats, even cloth hanker chiefs or other cloth materials such as turbans that are worn around a portion of a head of a person.

Many are worn for practical purposes, for example, to reduce exposure to the sun. Others are worn strictly for aesthetics, to project a particular image or appearance.

Regardless as to why a headpiece is worn, it is desirable that it optimally flatter the wearer. More than that, if a particular headpiece were somehow to stand out as being unique, then that would promote recognition of the wearer.

If an ornamentation is added to a headpiece, it needs to be durable, classy, and simple. It also needs to remain on the headpiece, even if subject to much movement. Accordingly, ornamental jewelry items are not suitable for such purposes.

Accordingly, there exists today a need for a headpiece ornament that helps to satisfy the above needs.

Clearly, such an apparatus would be a useful and desirable device as would a method for permanently attaching the headpiece ornament to the headpiece.

2. Description of Prior Art

Headpieces are, in general, well known. Jewelry that is worn directly on a person is also well known. While the structural arrangements of the above described devices, at first appearance, may have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a headpiece ornament that is economical to manufacture.

It is also an important object of the invention to provide a headpiece ornament that is installed at the time of manufacture of a headpiece.

It is also a still further important object of the invention to provide a headpiece ornament that can installed on a headpiece by a manufacture or the headpiece ornament or an authorized representative.

Another object of the invention is to provide a headpiece ornament that cannot be removed from a headpiece.

Still another object of the invention is to provide a headpiece ornament that cannot fall off of a headpiece.

Still yet another object of the invention is to provide a headpiece ornament that is circular.

Yet another important object of the invention is to provide a headpiece ornament that that is oval.

Still yet another important object of the invention is to provide a headpiece ornament that includes a geometric planar shape.

A first further object of the invention is to provide a headpiece ornament that provides an accent to a headpiece.

Briefly, a headpiece ornament that is constructed in accordance with the principles of the present invention has a continuous loop that may include a circular, oval, triangular, or other polygonal substantially planar shape. Once installed on a headpiece, the ornament cannot be removed from the headpiece. It is placed where desired on any type of a headpiece so that, preferably, at least a portion of the ornament is visible.

DETAILED DESCRIPTION OF THE INVENTION

Figure 1:
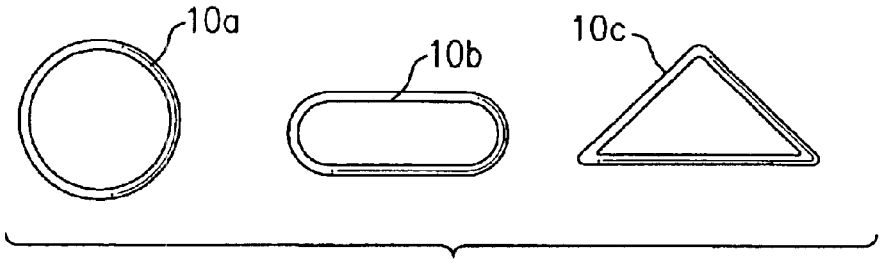
FIG. 1 is a plan view of several variations of a headpiece ornament.

Referring to FIG. 1 and also to the remaining figure drawings is shown, a headpiece ornament, identified in general by the reference numeral 10.

The headpiece ornament 10 may include any circular 10*a*, oval 10*b*, or other geometric shape 10*c* that forms a continuous loop or ring when attached to a headpiece. The stock that is used to form the headpiece ornament 10 can include a circular, oval, or polygonal cross-section, as desired. It can be any size (i.e., diameter) so as to make the headpiece ornament either more or less noticeable.

The headpiece ornament 10 can be formed out of any desired material and be any overall size. On small headpieces, a smaller version of the headpiece ornament 10 (i.e., smaller diameter stock and/or a smaller overall diameter of the ornament 10) may be preferred, whereas on larger headpiece sizes and styles, a larger version of the headpiece ornament 10 (i.e., larger diameter stock and/or a larger overall diameter of the ornament 10) is preferred.

Headpieces of all types are suitable for use with the headpiece ornament 10 a portion of the types of headpieces that are available are shown in remaining DRAWING FIGS. 2–11 and include various types of hats, caps, sun visors, berets, beanies, wool hats, even cloth hanker chiefs or other cloth materials such as turbans that are worn around a portion of a head.

The headpiece ornament 10 is intended to be included with all of these various headpieces as well as with any other type of a headpiece not shown. The term "headpiece" as used herein is intended to include any type of a garment that is worn proximate (i.e., in contact with) the head of a person.

The headpiece ornament 10 is primarily intended to be installed at the factory during manufacture of the headpiece. If the headpiece ornament 10 is formed of a metal (gold, silver, platinum, or other types of metals or alloys), then it is inserted through a hole that is provided in any of the headpieces (or it is inserted through naturally occurring openings, for example in between the threads of a wool hat).

After insertion through the hole, the disparate ends of the ornament 10 are brought into contact with each other and are soldered or welded together so as to form a continuous loop. This ensures that the headpiece ornament cannot become lost, fall from the headpiece, or be misplaced. It remains with the headpiece.

As such, manufacturers of the headpiece will likely welcome the benefits that are provided by the headpiece ornament in that their product lines are intended to become more distinctive and appealing to consumers.

It is important that when the headpiece ornament 10 is installed on the headpiece that a continuous loop be attained. Ordinary jewelry (not shown) includes a clasp that can become opened and lost. This is not suitable for use with the headpiece ornament 10. If the headpiece ornament 10 were to fall of the headpiece, the consumer would not likely purchase it or would purchase a less expensive version. Conversely, if the headpiece ornament 10 can never become separated apart from the headpiece, consumers are more apt to make such purchases, especially purchases that include more expensive variations of the headpiece ornament 10.

However, virtually any other type of material, including plastics or composite materials can also be used to form the headpiece ornament 10. If these are used, the ends are fused or glued together.

It is also possible to market the headpiece ornament 10 for retrofitting to existing headpieces (i.e., for after market sales). Because proper installation is important, the manufacturer of the headpiece ornament 10 may offer consumers the option to bring their favorite headpiece in to the ornament 10 manufacturer (or an authorized agent or representative of the ornament 10 manufacturer) for installation of the headpiece ornament 10 on their favorite headpiece in whatever location that they prefer. This provides great versatility to the consumer.

Installation of the ornament 10 on the headpiece is similar regardless of who installs it. The headpiece manufacturer must decide on the size, style, type, quantity, and location of the ornament 10 on the headpiece. The headpiece ornament 10 manufacturer, agent, or representative would assist the consumer in selecting the size, style, and material used for the headpiece ornament 10. Then both the headpiece manufacturer or the headpiece ornament 10 manufacturer, agent, or representative would form the hole (or holes if more than one of the headpiece ornaments 10 is to be simultaneously applied, as is described below in greater detail) where desired in the headpiece or in the favorite headpiece and do so in as safe a way as possible while also ensuring that the hole is of the proper size.

For example, a punch could be used to perforate the headpiece with an opening (i.e., hole) size that is precisely suited for the size of the headpiece ornament 10 that is selected. A tight fit between the headpiece ornament 10 and the headpiece itself prevents movement of the headpiece ornament 10 with respect to the headpiece, which in turn decreases wear of both the ornament 10 and the headpiece proximate the opening.

The manufacturer of the headpiece or the headpiece ornament 10 manufacturer, agent, or representative would pass a first end of the headpiece ornament 10 through the opening and urge the first end adjacent to a second end of the ornament 10. The body of the ornament 10 is then adjusted as necessary to ensure that the proper planar shape is attained, for example a circle, oval, triangle, or other polygonal shape. More complex shapes can also be included as part of the ornament 10, if desired.

Finally, the headpiece manufacturer or the headpiece ornament 10 manufacturer, agent, or representative would attach the first and second ends of the headpiece ornament 10 together after insertion through the hole and secure each end together using whatever is the preferred method. Solder, silver solder, gold solder, welding, fusing, epoxy, glue, and other methods are all possible depending upon the material used to form both the headpiece ornament 10 and also taking into account limitations concerning the headpiece itself and the desired appearance of the finished article.

Clearly, many other changes will become apparent to those as a result of having benefited from the instant disclosure. For example, more than one of the headpiece ornaments 10 can be used on any given headpiece as mentioned hereinabove. When more than one headpiece ornament 10 is used on the same headpiece, the size and shape of each one can also vary.

Accordingly, a way to personalize and accent the headpiece is provided that allows individual expression. After having benefited from the instant invention, many of the headpieces tend to appear mundane, even boring, without benefit of the headpiece ornament 10.

Figure 2:
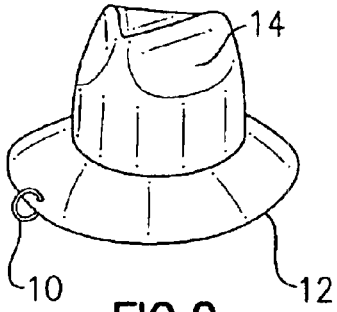
FIG. 2 is a view in perspective of a headpiece ornament on a rim of a hat, the hat being a type of headpiece.

Referring in particular now to FIG. 2, is shown the headpiece ornament 10 on a rim 12 of a hat 14, the hat 14 being a type of headpiece.

Figure 3:
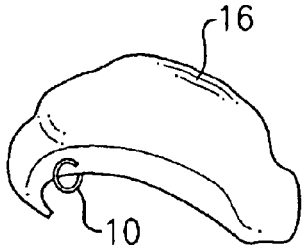
FIG. 3 is a view in perspective of a headpiece ornament on a beret, the beret being an alternative type of headpiece.

Referring in particular now to FIG. 3, is shown the headpiece ornament 10 on a beret 16, the beret 16 being an alternative type of headpiece.

Figure 4:
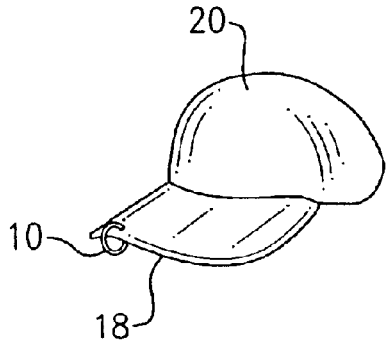
FIG. 4 is a view in perspective of a headpiece ornament on a bill of a cap, the cap being an alternative type of headpiece.

Referring in particular now to FIG. 4, is shown the headpiece ornament 10 on a bill 18 of a cap 20, the cap 20 being an alternative type of headpiece.

Figure 5:
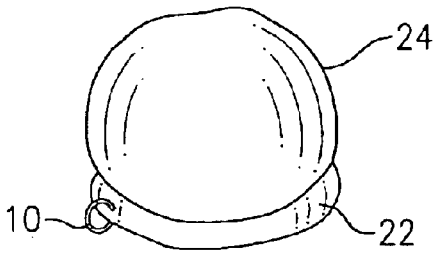
FIG. 5 is a view in perspective of a headpiece ornament on a rolled brim of a wool hat, the wool hat being an alternative type of headpiece.

Referring in particular now to FIG. 5, is shown the headpiece ornament 10 on a rolled brim 22 of a wool hat 24 the wool hat 24 being an alternative type of headpiece.

Figure 6:
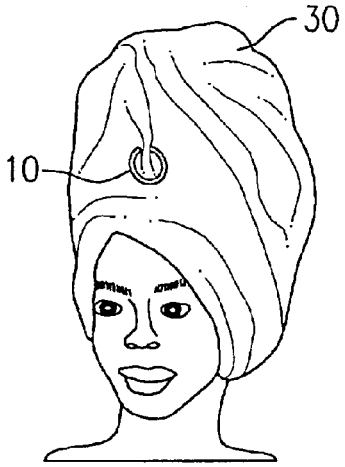
FIG. 6 is a view in perspective of a headpiece ornament on a turban, the turban being an alternative type of headpiece.

Referring in particular now to FIG. 6, is shown the headpiece ornament 10 on a turban 26, the turban 26 being an alternative type of headpiece.

Figure 7:
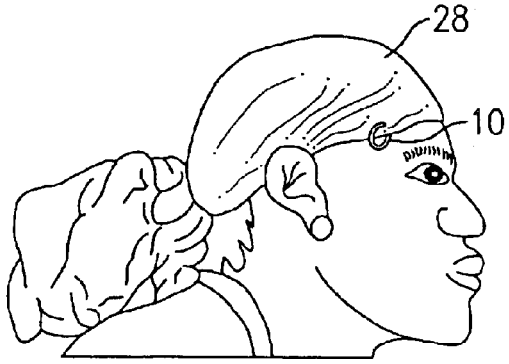
FIG. 7 is a view in perspective of a smaller size of a headpiece ornament on a cloth headpiece, the cloth headpiece being an alternative type of headpiece.

Referring in particular now to FIG. 7, is shown a smaller size of the headpiece ornament 10 on a cloth headpiece 28, the cloth headpiece 28 being an alternative type of headpiece.

Figure 8:
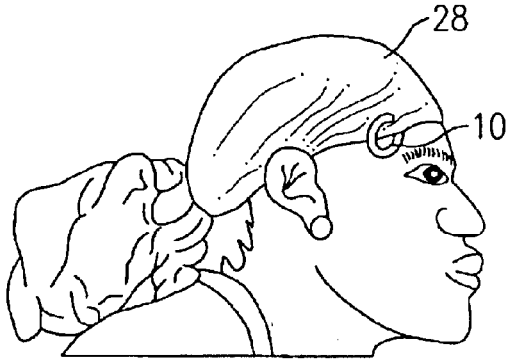
FIG. 8 is a view in perspective of a larger size of a headpiece ornament on the cloth headpiece of FIG. 7.

Referring in particular now to FIG. 6, is shown a larger size of the headpiece ornament 10 on the cloth headpiece 28 of FIG. 7. FIG. 7 and FIG. 8 show by way of comparison that different sizes of the headpiece ornament 10 can be used on any given type of headpiece.

Figure 9:
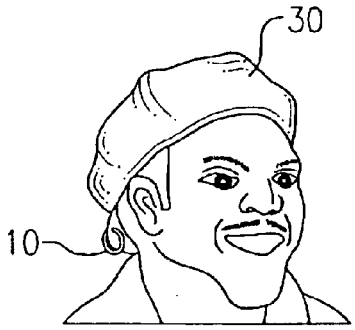
FIG. 9 is a view in perspective of a headpiece ornament on a bill of a stylish cap, the stylish cap being an alternative type of headpiece.

Referring in particular now to FIG. 9, is shown the headpiece ornament 10 on a bill of a stylish cap 30, the bill facing to the rear of the wearer and the stylish cap 30 being an alternative type of headpiece.

Figure 10:
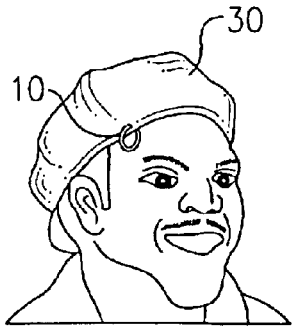
FIG. 10 is a view in perspective of a headpiece ornament on and edge of the stylish cap of FIG. 9.

Referring in particular now to FIG. 10, is shown the headpiece ornament 10 on an edge of the stylish cap 30 of FIG. 9.

Figure 11:
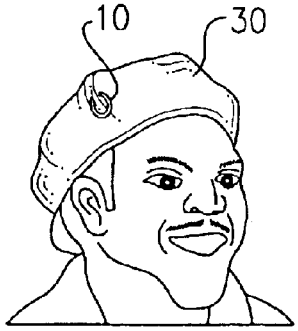
FIG. 11 is a view in perspective of a headpiece ornament on the body of the stylish cap of FIG. 9.

Referring in particular now to FIG. 11, is shown the headpiece ornament 10 on the body of the stylish cap 30 of FIG. 9.

By way of comparison, FIGS. 10–11 show how varying the location of the headpiece ornament 10 on the same headpiece can create and entirely different appearance or "look" thereby personalizing the appearance to match the mood of the wearer.

It is also noted that when the headpiece ornament 10 is inserted into a brim or edge of the headpiece, that only one hole is required in the headpiece to accept the ornament 10. However, when the headpiece ornament 10 is inserted into the body of the headpiece (see FIG. 11), then two adjacent openings (i.e., holes) must be provided in the body, one to accept the entry of one side of the ornament 10 and the other to allow for its exit on the same side of the headpiece.

If desired, the two openings can be located on a protruding fold of the headpiece (so that the ornament 10 is flush with the surface of the headpiece) or the two openings can be spaced apart from each other any desired amount.

If desired, any other type of an item can also be attached to the headpiece ornament including items that are part of its structure or suspended from it. For example, precious stones, such as a diamond or diamonds, can be included with the headpiece ornament 10 as desired.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A combination comprising a headpiece and an accent device for permanent attachment to said headpiece, (a) wherein said headpiece is adapted to be worn proximate the head of a user and wherein at least a portion of said headpiece is in contact with the head of the user;

(b) said accent device comprising an ornament, said ornament adapted to pass through at least one opening that is provided in said headpiece and wherein, when said ornament is disposed through said at least one opening, said ornament includes a structure that is substantially disposed on a plane and wherein said ornament includes a continuous loop.

2. The accent device of claim 1 wherein said continuous loop includes a circle.

3. The accent device of claim 1 wherein said continuous loop includes an oval.

4. The accent device of claim 1 wherein said continuous loop includes a triangle.

5. The accent device of claim 1 wherein said continuous loop includes a polygon.

6. The accent device of claim 1 wherein said continuous loop is disposed through a bill of said headpiece.

7. The accent device of claim 1 wherein said continuous loop is disposed through an edge of said headpiece.

8. The accent device of claim 1 wherein said continuous loop is disposed through a body of said headpiece and wherein said at least one opening includes two openings.

9. The accent device of claim 1 wherein said headpiece is selected from a list of headpieces consisting of: a hat, a beret, a wool hat, a turban, a cap, and a cloth headpiece.

10. A method for installing a headpiece ornament onto a headpiece, comprised of the steps of:

(a) providing at least one opening in said headpiece;

(b) providing a headpiece ornament including a first end and an opposite second end, wherein a length of material is disposed intermediate said first end and said second end;

(c) passing said first end of said headpiece ornament through said at least one opening;

(d) urging said first end and said second end adjacent to each other; and (e) attaching said first end and said second end together.

11. The method of claim 10 including the step of forming said headpiece ornament into a substantially planar structure that includes a circle before the step of urging said first end and said second end adjacent to each other.

12. The method of claim 10 including the step of forming said headpiece ornament into a substantially planar structure that includes an oval before the step of urging said first end and said second end adjacent to each other.

13. The method of claim 10 including the step of forming said headpiece ornament into a substantially planar structure that includes a triangle before the step of urging said first end and said second end adjacent to each other.

14. The method of claim 10 including the step of forming said headpiece ornament into a substantially planar structure that includes a polygon before the step of urging said first end and said second end adjacent to each other.

15. The method of claim 10 wherein the step of attaching said first end and said second end together includes the step of soldering said first end and said second end.

16. The method of claim 10 wherein the step of attaching said first end and said second end together includes the step of welding said first end and said second end.

17. The method of claim 10 wherein the step of attaching said first end and said second end together includes the step of adhering said first end and said second end.

18. The method of claim 17 wherein the step of adhering said first end and said second end includes the step of gluing said first end and said second end.

19. The method of claim 10 wherein the step of attaching said first end and said second end together includes the step of fusing said first end and said second end.

* * * * *